United States Patent [19]

Gibbon et al.

[11] Patent Number: 4,637,614

[45] Date of Patent: Jan. 20, 1987

[54] COLLECTOR'S AUCTION GAME

[76] Inventors: Linda M. Gibbon; Randolph H. Gibbon, both of 14030 Harrisville Rd., Mt. Airy, Md. 21771

[21] Appl. No.: 788,967

[22] Filed: Oct. 18, 1985

[51] Int. Cl.[4] ..... A63F 3/00

[52] U.S. Cl. ..... 273/271; 273/278

[58] Field of Search ..... 273/256, 274, 278, 273, 273/148 A, 297, 293, 271

[56] References Cited

U.S. PATENT DOCUMENTS

| | | | |
|---|---|---|---|
| 2,458,966 | 1/1949 | Waldrop | 273/256 |
| 2,717,156 | 9/1955 | Nelson | 273/148 A |
| 3,602,512 | 8/1971 | Krugier | 273/278 |
| 4,378,942 | 4/1983 | Isaac | 273/278 |

*Primary Examiner*—Richard C. Pinkham

*Assistant Examiner*—MaryAnn Stoll Lastova

*Attorney, Agent, or Firm*—Richard C. Litman

[57] ABSTRACT

An auction game in which competitive bidding is involved for the purpose of attaining a complete collection of items defined by a collection of cards reflecting various items termed "collectibles" comprising furniture, glassware, etc., and in which a "house" card is provided with portions corresponding to the "collectibles" and upon which the "collectible" cards are stored; points being awarded for attaining a complete collection during bidding and progress of the game, with the game being supervised by a "Banker" and each participant serving as the "Banker"; the game including not only bidding, but refinancing, and strategy of maintaining one's collection and being able to purchase at or below appraised values of the "collectibles."

4 Claims, 6 Drawing Figures

| Item | Point Value | Red Bonus | Blue Bonus | Total |
|---|---|---|---|---|
| Sofa | | | | |
| Armchair | | | | |
| Dining Rm. Chair | | | | |
| Table | | | | |
| Chest | | | | |
| Mirror | | | | |
| Desk | | | | |
| Clock | | | | |
| Sideboard | | | | |
| Misc. | | | | |
| Misc. | | | | |
| Misc. | | | | |
| Misc. | | | | |
| Misc. | | | | |
| | | | TOTAL | |
| | Bonus Collection Points | | | |
| | | | TOTAL | |

34

COLLECTOR'S AUCTION GAME

BACKGROUND OF THE INVENTION

1. Field of the Invention

This invention relates generally to games and particularly to an auction game. More specifically, the auction game incorporates features of game boards each represnting a house upon which progress of the game is maintained by each of the players, and includes the competitive features of an auction and bidding within one's means or upon speculation.

2. Description of the Prior Art

Game board games simulating various aspects of day-to-day encounters are well known; for example, in the patent to Ripley, (U.S. Pat. No. 2,693,961), various aspects of bargaining, inflationary, and deflationary periods are considered and misfortunes or successes are shown to depend upon chance.

Likewise, in the patent to Stadler, (U.S. Pat. No. 3,506,268), there is shown a game board with plural playing paths and stations, with periodic auctioning in accordance with conditions of play and in relation to an electrically driven device stopped at a player's option.

In the patent to Johnson, (U.S. Pat. No. 3,228,694), a game board simulating a livestock auction is utilized and players use livestock purchase cards having indicia representative of actual market value of the various livestock.

None of the prior art games simulate 'collections' of items of the nature involved in the present invention.

SUMMARY OF THE INVENTION

The present auction game is designed so that the players competitively bid against one another for item cards until a game board representing a house is filled with cards representing items from collections and other items; the items of the collection are afforded designated point values; extra points are awarded as multiple pieces of a single collection are accumulated; bonus or mystery points are awarded at the end of a game which may have a substantial outcome in determining the winner of that game. Simulated money of an equal amount is given each player. One player is selected during each auctioning session to act as the banker or judge. The players, during the game, learn to recognize various collectible items and the history of a collection of the items; learn how to manage their capital, learn how to refinance or sell some of their collected items to finance continued play, and learn how to get along and deal or trade with one another, all within a spirit of competition and amusement.

DESCRIPTION OF THE PREFERRED EMBODIMENT

Figure 1:
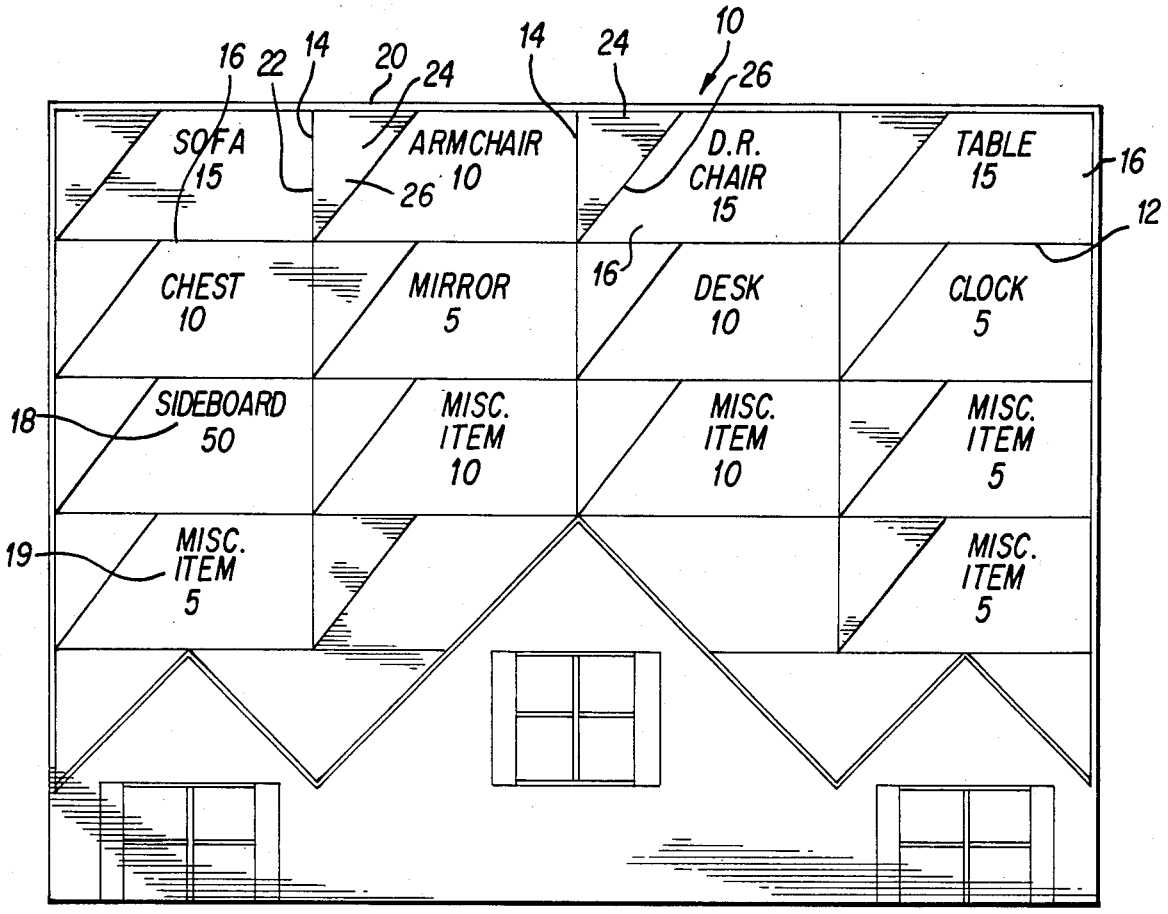
FIG. 1 is a plan view of a game board depicting a house to fill, which each player of the game maintains.

Referring to FIG. 1, each player is provided with a game board representing a house which is indicated generally at 10. The house board is where the auction-item cards representing individual collectable items which are purchased by the player are stored; the house card being generally rectangular and being divided by horizontal and vertical lines 12 and 14 into card-holding segments 16; indicia 18 on the cards each designates a specific item and point values; and indicia 19 identifies a miscellaneous item and its designated point value. Each card holding segment has secured at one corner, at two intersecting sides 20, 22 a triangular segment 24, which includes a free edge 26 intersecting the sides 20, 22 and forming a triangular envelope pocket which will accomodate either an item card 26 together with a blue flag 28, a red flag 30 or both; the purpose of which becomes evident when the rules of play for the game are described.

In addition to the item cards and the flags, the game pieces include simulated money in denominations of $5 to $500 as indicated at 32. Additionally, each player will be provided with a tally sheet 34. Further, a suitable chance device such as dice or a spinner may be provided for the purpose of selecting the first Banker of the game whose duties during play will become apparent in the Rules of Play of the Game.

Figure 2:
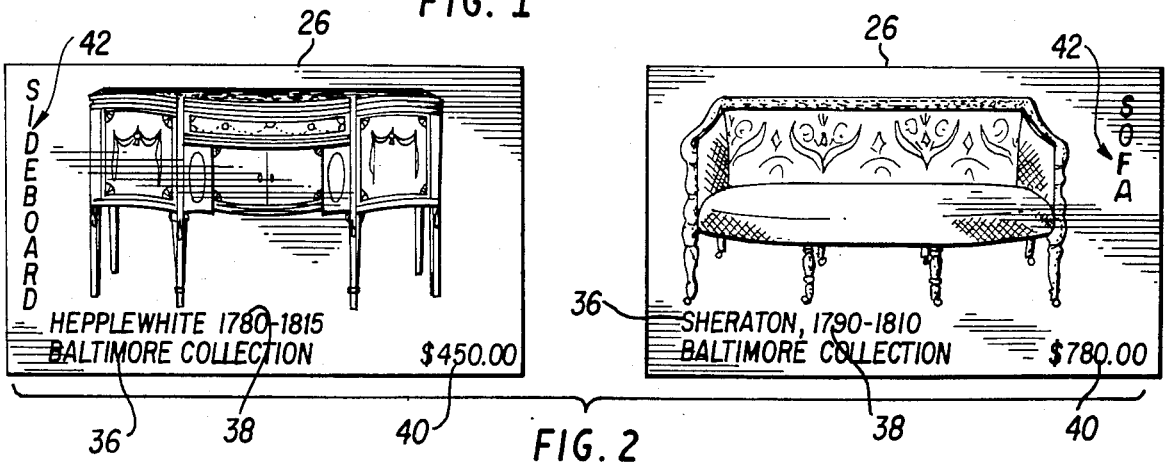
FIG. 2 are plan views of typical auction-item cards depicting the pieces of typical, different collections.
Figure 3:
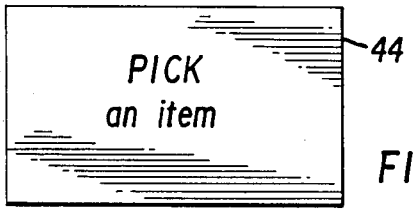
FIG. 3 illustrates a Pick an Item card
Figure 4:
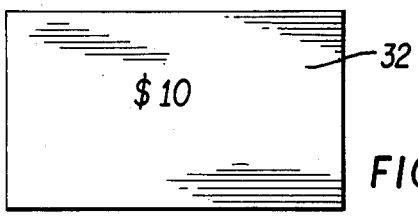
FIG. 4 illustrates the simulated money distributed to each of the players.
Figures 5, 6:
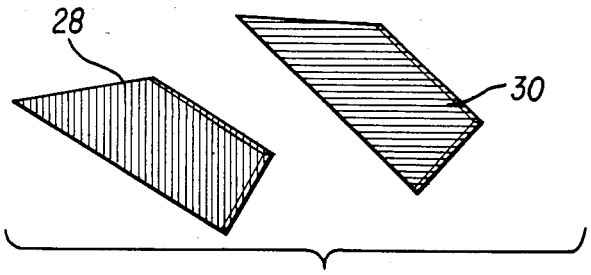
FIG. 5 illustrates a tally sheet.
FIG. 6 illustrates bonus flags awarded as the game progresses.

A group of auction-item cards is furnished. Some of The item cards 26 will have produced thereon names of various collectible items such as those illustrated in FIG. 2; the exemplary one showing the name of the collection at 36, a short description of the item including its period of origin as indicated at 38; the appraised price value as indicated at 40, and the generic name of the device as indicated at 42. It will be noted that the title of the piece 42, i.e., sofa: corresponds to the title 42 appearing at the respective card holding segments of the game board 10. The item cards of the collectibles items will include furniture, antiques, glassware, china, and other items required to furnish a house and live therein.

There will be provided, two for each player, Pick An Item cards 44, which will assist during the course of play of the game.

RULES OF PLAY OF THE GAME

A Banker is selected by a throw of the dice or by using a spinner, or is appointed by agreement of the players; the Banker controls an auction session and interprets the rules and procedure of the auction; the Banker may change for each auction session; after once chosen, the Banker, may relinquish this position to the person to the Banker's right hand, which is the bidding procedure of a game session.

THE "COLLECTIONS"—There are six collections to which some of the auction items belong. The names of the collections are:

The Atlanta Collection
The Baltimore Collection
The Boston Collection
The New Orleans Collection
The Philadelphia Collection
The Richmond Collection If a player purchases more than two items from the same collection, each piece he/she owns from that collection gets a red flag, worth five extra points.

The nine required items on the house card will be identified as belonging to one of these collections. The miscellaneous items may or may not belong to a collection.

A deck of cards containing the names of each of the collections is provided. At the beginning of the game the name of one collection is drawn from the deck containing the collection names. That is the bonus collection, and the card is entrusted to the Banker and is not revealed until the end of the game. All pieces purchased belonging to that collection are worth five extra points.

THE AUCTION ITEMS—The item cards 26 depicting the items for sale at the auction contain a small description of that piece, the collection (if any) it belongs to, and the appraised value of that piece. If an item is purchased for less than its appraised value, that piece gets a blue flag worth five extra points. Any item may be purchased to fill a place marked "misc" on the house.

"PICK AN ITEM" CARDS—Each player gets two Pick An Item cards 44. These may be used at any time during the game when presented at the beginning of a round of bidding. It entitles the player to choose the item for the next bid. If two players want to use their Pick An Item cards during the same round, the player with the highest score may have the first choice. When choosing a specific item, all other players should check their house boards to see if they have already purchased that item. If so, that player may then choose to sell or keep the item.

The "Pick An Item" cards may be bought or sold from one player to another, or sold to the bank for $150.00.

BANKRUPTCY—If a player is close to or becomes bankrupt before the game ends, the player may sell one of his items during the next round of bidding, or the player may sell the item to the bank for the appraised value. If a player bids more for an item than the money the player has available, that player must then sell another item to pay for it.

SCORING—Each auction item purchased is worth the point value written in its space on the house. Each flag, red or blue, is worth five points. Each piece from the "bonus collection" revealed at the end of the game is worth five points. The player who is the first to fill their house board earns 20 points. Each player may use a tally sheet to keep score throughout the game.

THE SET-UP—Each game contains a house board 10 for each of six players or teams. (Additional houses may be purchased for more players.) Each player is given:

* A House board to fill
* $10,500 in simulated money with which to purchase the fourteen items needed to fill the house board, in the following denominations:

16-$500's
15-$100's
10-$50's
17-$20's
11-$10's
10-$5's

* 2 "Pick An Item" cards
* A tally sheet

One player is selected as the Banker. The player to the right of banker begins the first round of bidding. The desck of Auction item cards is shuffled and placed face down where all players can view the items as they are drawn. The Bonus Collection cards are shuffled and one card is drawn and entrusted to the banker, not to be revealed until the end of the game.

AN AUCTION ROUND—Each round begins in rotation, with each succeeding player drawing an auction Item card 26 and reading its description to the other players. That player then places the first bid, which must be at least one half the appraised value of that piece, or the player may pass. The following player must bid higher (bids must be made in $5 increments) or pass. The bidding continues around until the remaining highest bidder buys that item.

If an auction item is drawn that no one is interested in bidding for, that card is placed at the bottom of the deck and a new auction item card is drawn.

The auction continues until one player has all fourteen items on the house board. At that time the game ends and scores are totaled on the tally sheets, the Bonus Collection is revealed, and the player with the highest score wins.

The game requires at the least two players, i.e., at least one Banker and one competing bidder, and can include up to 6 players or teams and a Banker, thus totaling 7 participants in a given auctioning session. There can be more if additional house cards are purchased. If there are more than seven players, after each auctioning session the player being bankrupt or players earning the fewest points can be replaced by those desiring to play, in that order.

Thus, there is disclosed a game which teaches the discipline of order, set procedures, and accepting the Rules and rulings of the Banker; teaches the basic history of various collectibles; teaches the competitiveness of auctioning and going bankrupt; and teaches how to succeed in winning an auction round through clever management and maintaining one's finances. Finally, the outcome of the game, after all tallying is completed, may be materially disturbed through the exposure of the Bonus Collection, adapting the players to realize that nothing is certain until the game is completed. Manifestly, many modifications of the present game may be envisioned without departing from the scope of the invention, as defined by the following claims.

I claim:

1. An auction game apparatus providing for competitive bidding between players comprising in combination: a game board for each player, said game board representing a house and having a plurality of pockets thereon for receiving and storing auction-item cards, certain pockets of the game board bearing the names of specific collectable items which must be bought and inserted therein to furnish the house, other pockets for receiving miscellaneous auction-item cards required to fill the game board, all pockets of the game board bearing point values for the auction-item cards inserted therein; a group of auction-item cards each having a description of an item which may be used to furnish the house, said group of cards containing cards indicating a designated collectable item of furniture, a collection to which the item belongs, the history of the item, and its appraised value and each of said collectable item cards corresponding to one of the designated collectable item playing board pockets and said group of auction-item cards containing a number of other cards representing other items which may or may not belong to a collection which may be used to fill pockets on the game board not having a collectable item name, a second deck of cards containing only the names of the specific collections, simulated money for distribution to and use by the players to bid on and acquire auction-item cards, and bonus means for rewarding players for skill in bidding for and acquiring items required to fill the game board.

2. The game apparatus as defined in claim 1 wherein a bonus flag is awarded a player who acquires an item during bidding for less than its appraised value.

3. The game apparatus of claim 1 wherein a bonus flag is awarded a player who acquires two or more items from the same collection.

4. The game apparatus of claim 1 wherein the players are provided with tally sheets to score the point values of the auction-item cards acquired.

* * * * *